US009721773B2

(12) United States Patent
Yamamoto et al.

(10) Patent No.: US 9,721,773 B2
(45) Date of Patent: Aug. 1, 2017

(54) MASS SPECTROMETRIC DEVICE AND MASS SPECTROMETRIC DEVICE CONTROL METHOD

(71) Applicant: HITACHI HIGH-TECHNOLOGIES CORPORATION, Tokyo (JP)

(72) Inventors: Akio Yamamoto, Tokyo (JP); Toshimitsu Watanabe, Tokyo (JP); Shigeo Ootsuki, Tokyo (JP); Kazuki Kajima, Tokyo (JP); Toshiaki Yanokura, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 14/898,158

(22) PCT Filed: May 30, 2014

(86) PCT No.: PCT/JP2014/064359
§ 371 (c)(1),
(2) Date: Dec. 14, 2015

(87) PCT Pub. No.: WO2015/001881
PCT Pub. Date: Jan. 8, 2015

(65) Prior Publication Data

US 2016/0141163 A1 May 19, 2016

(30) Foreign Application Priority Data

Jul. 5, 2013 (JP) ..... 2013-141300

(51) Int. Cl.
*H01J 49/00* (2006.01)
*H01J 49/10* (2006.01)
*H01J 49/04* (2006.01)

(52) U.S. Cl.
CPC ..... *H01J 49/0031* (2013.01); *H01J 49/0409* (2013.01); *H01J 49/0495* (2013.01); *H01J 49/102* (2013.01)

(58) Field of Classification Search
None
See application file for complete search history.

(56) References Cited

U.S. PATENT DOCUMENTS

2010/0301209 A1 12/2010 Ouyang et al.
2011/0108726 A1 5/2011 Hiraoka et al.
(Continued)

FOREIGN PATENT DOCUMENTS

JP 2008-053020 A 3/2008
JP 2009-060653 A 3/2009
(Continued)

OTHER PUBLICATIONS

International Search Report of PCT/JP2014/064359.

*Primary Examiner* — Jack Berman
(74) *Attorney, Agent, or Firm* — Mattingly & Malur, PC

(57) ABSTRACT

This mass spectrometric device is provided with a sample container (8) for placing a measurement sample (12) therein, a detector (9) analyzing the mass of a sample and detecting a drug, or the like, in the sample, a dielectric container (3) linked to the sample container for running a discharge current into air to provoke ionization, a valve (2) for sending air intermittently to the sample container, the dielectric container and the detector, a barrier discharge high-voltage power source (6) to be discharged by the dielectric container, a current detection unit (5) connected to the barrier discharge high-voltage power source for detecting a discharge current (28), a discharge-start timing detection unit (7) connected to the current detection unit for detecting the discharge-start timing based on the current detection result from the current
(Continued)

detection unit to send a discharge-start timing signal (17), and a control unit (11) for controlling each constituent.

4 Claims, 10 Drawing Sheets

(56) References Cited

U.S. PATENT DOCUMENTS

| | | | | |
|---|---|---|---|---|
| 2011/0253889 | A1* | 10/2011 | Ishimaru ..... | H01J 49/145<br>250/282 |
| 2011/0260732 | A1 | 10/2011 | Shinada et al. | |
| 2012/0112061 | A1* | 5/2012 | Morokuma ..... | H01J 49/0031<br>250/288 |
| 2013/0032711 | A1 | 2/2013 | Ishiguro et al. | |

FOREIGN PATENT DOCUMENTS

| | | | |
|---|---|---|---|
| JP | 2011-232071 | A | 11/2011 |
| JP | 2012-104247 | A | 5/2012 |
| JP | 2013-037815 | A | 2/2013 |
| WO | 2009/023361 | A2 | 2/2009 |

* cited by examiner

MASS SPECTROMETRIC DEVICE AND MASS SPECTROMETRIC DEVICE CONTROL METHOD

TECHNICAL FIELD

The present invention relates to a mass spectrometric device and a mass spectrometric device control method.

BACKGROUND ART

As a device for quickly determining a component of trace material included in a sample, a small and lightweight mass spectrometric device (often referred to as MS) has become necessary. In particular, a market is expanding as a sensing device of an illegal drug and an explosive. The mass spectrometric device ionizes a molecule in the sample to be analyzed, and detects an ion ionized by mass separation using an electric field and a magnetic field with a detector.

As a method for ionizing the molecule in the sample, APCI (Atmospheric Pressure Chemical Ionization Source), an electron impact ionization method, glow discharge, and the like have been put into practice; however, there are many inadequate points such as low ionization efficiency, and occurrence of fragmentation. Therefore, high precision adjustment is required to cope with these inadequate points, and the device tends to become large. On the other hand, as a relatively new method that is superior in terms of the ionization efficiency and the fragmentation, an atmospheric pressure dielectric barrier discharge method has begun to be studied in recent years. The barrier discharge ionizes the molecule in the sample by making a discharge current flow by applying a pulse-like or sine-wave-like high voltage via a dielectric barrier to a discharge unit in which the sample is introduced and that has a pressure close to the atmospheric pressure.

As a mass spectrometric device using the barrier discharge in an ionization unit, there are techniques described in PATENT LITERATURE 1 (JP 2012-104247 A), PATENT LITERATURE 2 (PCT/US2008/065245), PATENT LITERATURE 3 (PCT/JP2009/060653).

In PATENT LITERATURE 1, there is provided a small and lightweight mass spectrometric device capable of high precision mass spectrometry. The mass spectrometric device has an ionization source for ionizing a gas flowing in from the outside for ionizing a measurement sample, and a mass spectrometry unit for separating the ionized measurement sample. The barrier discharge is used for the ionization source. In PATENT LITERATURE 1, the mass spectrometric device has a suppression means for suppressing a flow rate of the gas taken into the ionization source, and an opening/closing means for opening and closing flow of the gas taken into the ionization source. By making the gas introduced from the outside intermittently flow into the ionization unit, and also by operating the barrier discharge unit intermittently at a pressure of 100 Pa to 10000 Pa lower than the atmospheric pressure, high efficiency and downsizing are achieved.

In PATENT LITERATURE 2, it is described about a method for obtaining high efficiency by ionizing the sample at the atmospheric pressure with the barrier discharge in the mass spectrometric device and discontinuously introducing the ionized sample to the mass spectrometry unit.

In PATENT LITERATURE 3, it is described about a method for improving ionization efficiency of the sample by devising electrode structure of the barrier discharge unit.

Although it is not an example of the barrier discharge, as a stabilization technique of the discharge unit, in relation to a device for detecting the discharge current, there are devices disclosed in PATENT LITERATURE 4 (JP 2011-232071 A), PATENT LITERATURE 5 (JP 2008-53020 A).

In PATENT LITERATURE 4, the device performs high S/N ionization current detection by detecting the discharge current of the discharge unit and integrating the ionization current in the device only in a period in which the discharge current flows.

In PATENT LITERATURE 5, it is described about a method for achieving noise reduction by detecting a current flowing through a discharge electrode and controlling an applied voltage so that the current becomes a predetermined current, to stabilize the ionization with the APCI (Atmospheric Pressure Chemical Ionization method) and reduce a noise level in the mass spectrometric device.

CITATION LIST

Patent Literatures

Patent Literature 1: JP-A-2012-104247
Patent Literature 2: PCT/US2008/065245
Patent Literature 3: PCT/JP2009/060653
Patent Literature 4: JP-A-2011-232071
Patent Literature 5: JP-A-2008-53020

SUMMARY OF INVENTION

Technical Problem

It has become apparent by experiments that, in the barrier discharge, depending on the surrounding environment, variation occurs in an applied high voltage at the time of discharge-start, and in time from the high voltage application start to the discharge start.

In documents in CITATION LIST, the ionization efficiency is improved by such as pressure reduction of the ionization unit, intermittent operation of the ionization source, electrode structure optimization of the ionization source, and the discharge current is detected and the applied voltage is controlled so that the discharge current becomes the predetermined discharge current, and the S/N of the measurement value is improved by measuring the ionization current only in the period in which the discharge current flows, however, variation in the discharge-start voltage and variation in discharge-start time are not focused.

In addition, in a mass spectrometric device that intermittently operates the ionization source, an atmosphere is ionized by causing the barrier discharge by applying a high voltage to the atmosphere of a low pressure multiple times intermittently, and a measured object is ionized by the ionized body to perform mass spectrometry. Since each application period is constant of the high voltage to be applied multiple times, when variation occurs in the time from the high voltage application start to the discharge start as described above, there are problems that variation occurs in a period in which the barrier discharge is caused depending on each period, change occurs in an amount of the measured object to be ionized, and accuracy of a mass spectrometry result is degraded.

Therefore, the present invention aims to provide a mass spectrometric device and a mass spectrometric device control method that suppress change of the amount of the measured object to be ionized and accuracy degradation of the mass spectrometry result.

Solution To Problem

To solve the above problems, a configuration is adopted according to the appended claims, for example.

The present application includes several means for solving the above problems, and an example thereof is a mass spectrometric device including: a sample container for containing a measurement sample; a detector for detecting a drug and the like included in the sample by analyzing mass of the sample; a dielectric container for coupling with the sample container and for ionizing an atmosphere by making a discharge current flow through the atmosphere; a valve for intermittently sending the atmosphere to the sample container, the dielectric container, and the detector; a barrier discharge high-voltage power source for causing discharge in the dielectric container; a current detection unit connecting with the barrier discharge high-voltage power source and for detecting a discharge current; a discharge-start timing detection unit for connecting with the current detection unit and for detecting discharge-start timing based on a current detection result of the current detection unit to transmit a discharge-start timing signal; and a control unit for controlling each constituent, wherein the current detection unit converts the detected current to a voltage, and compares the converted voltage with a threshold set in the discharge-start timing detection unit, and transmits a discharge-start signal to the control unit when the converted voltage exceeds the threshold, and the control unit performs control to cause discharge for a certain period after receiving the discharge-start signal.

Advantageous Effects of Invention

In the present invention, a mass spectrometric device and a mass spectrometric device control method can be provided that suppress change of an amount of a measured object to be ionized and accuracy degradation of a mass spectrometry result.

DESCRIPTION OF EMBODIMENTS

In the following, embodiments are described with reference to the drawings.

First Embodiment

In the present embodiment, a configuration and a control method are presented for detecting discharge-start timing by using discharge current detection and for controlling a high voltage output by using the timing.

Figure 1:
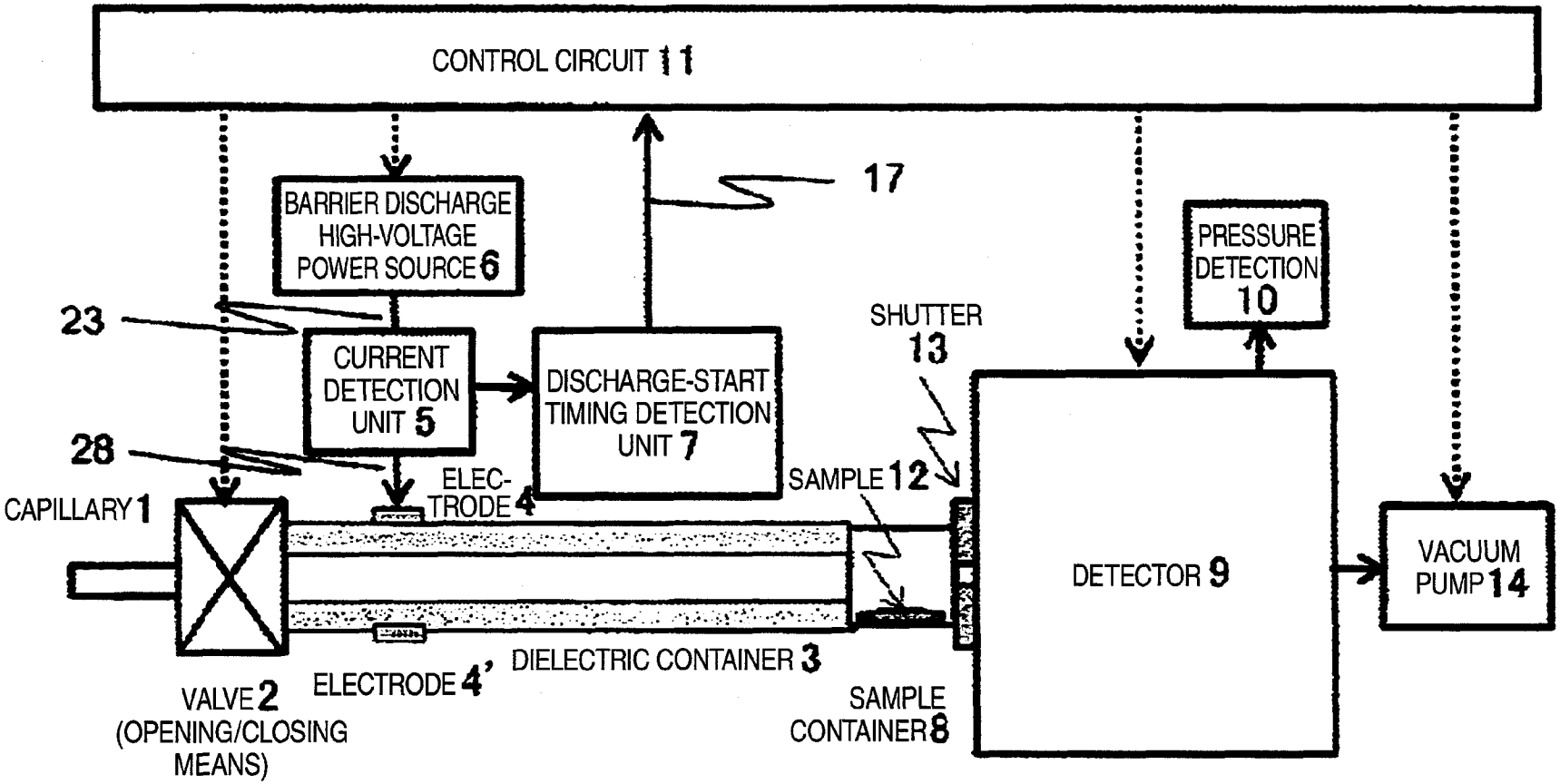
FIG. 1 is an example of a configuration diagram of a mass spectrometric device according to a first embodiment.

FIG. 1 illustrates a block diagram of a mass spectrometric device of the present invention. The mass spectrometric device is configured of: a capillary 1 for introducing an atmosphere; a valve 2 that is an opening/closing means for intermittently sending the atmosphere to a discharge unit; a dielectric container 3 for ionizing (reactant ion generation) the introduced atmosphere by making a discharge current 28 flow through the introduced atmosphere; a barrier discharge high-voltage power source 6 for causing discharge in the dielectric container 3; an electrode 4, electrode 4' each to which a high-voltage power source is applied; a current detection unit 5 for detecting the discharge current 28; a discharge-start timing detection unit 7 for detecting the discharge-start timing from a current detection result to provide a discharge-start timing signal 17 to a control circuit 11 of a control unit; a sample container 8 for containing a measurement sample; a detector 9 for detecting a drug and the like included in the sample by analyzing mass of the sample; a pressure detection unit 10 for detecting pressures in the dielectric container 3 and the detector 9; a vacuum pump 14 for reducing the pressures in the dielectric container 3 and the detector 9; and the control circuit 11 for controlling each block.

Figure 2:
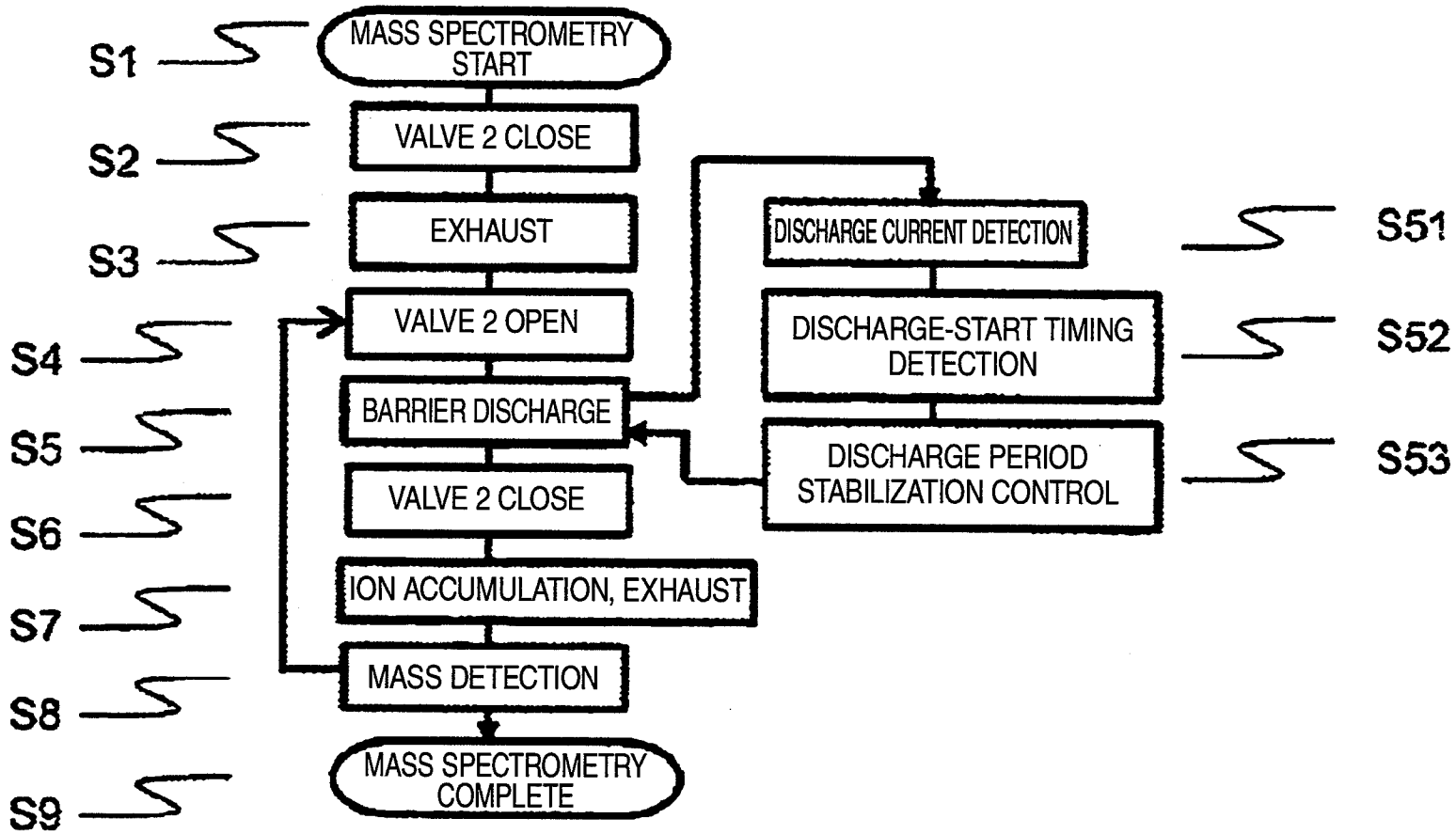
FIG. 2 is an example of an analysis processing flow of the mass spectrometric device according to the first embodiment.

FIG. 2 illustrates a mass spectrometry flow of the mass spectrometric device of the present invention. The mass spectrometry operation is described with reference to the flow.

At sequence 1 (S1), the mass spectrometry is started. At sequence 2 (S2), the valve 2 is closed. At sequence 3 (S3), gases in the dielectric container 3 and the detector 9 are exhausted by the vacuum pump 14 to reduce the pressures (for example, 100 Pa in the dielectric container 3, 0.1 Pa in the detector 9). At sequence 4 (S4), by opening the valve 2, the atmosphere is introduced to the dielectric container 3 via the capillary 1.

After introducing the atmosphere, a predetermined time has elapsed and an inside of the dielectric container 3 is filled with the atmosphere of a low pressure (for example, 1000 Pa), and then at sequence 5 (S5), by applying a pulse-like high voltage to the electrode 4, electrode 4' from the barrier discharge high-voltage power source 6 and causing the barrier discharge in the dielectric container, the introduced atmosphere of the low pressure is ionized (reactant ion generation).

After completion of the barrier discharge, at sequence 6 (S6), the valve 2 is closed. The atmosphere including the reactant ion is introduced to the sample container 8 to ionize a sample 12 of the inside. At sequence 7 (S7), the ionized sample 12 is introduced to the detector 9 to be trapped and accumulated in the detector 9. At the same time, exhaust is started by the vacuum pump 14, and an unnecessary atmosphere is exhausted, and the pressures in the dielectric container 3 and the detector 9 are reduced again.

Then, at sequence 8 (S8), the ionized state sample 12 trapped and accumulated in the detector 9 is processed in the detector 9 to detect the drug and the like included in the sample 12. When the mass detection operation is continued, the operation is returned to sequence 4 (S4), and the sequences described above are repeated, and after completing n times of repetition that is the number of times of repetition determined in the control circuit 11, at sequence 9 (S9), the mass spectrometry is completed.

Incidentally, for the mass spectrometry result, an average of results in the n times of repetition can be used as a detection result, and the most sensitive result can be used as a detection result, and only some measurement results of the n times of repetition can be used as detection results.

Described above is the general flow of the mass spectrometry. Here, it is described for the detailed sequence according to the present embodiment. At sequence 5 (S5), the pulse-like high voltage is applied to the electrode 4, electrode 4' from the barrier discharge high-voltage power source 6. In a period in which the barrier discharge is caused in the dielectric container, at sequence 51 (S51), the current detection unit 5 detects the discharge current 28 that flows due to the high voltage applied to the electrode from the barrier discharge high-voltage power source 6. From the detection result at sequence 52 (S52), the discharge-start timing detection unit 7 detects the timing at which the discharge is caused in the period in which the high voltage is applied. At sequence 53 (S53), in the control circuit 11, for a certain period from the discharge-start timing, by controlling the barrier discharge high-voltage power source 6 to output the high voltage to apply to the electrode 4, the discharge period is controlled to be constant.

As described above, in the repeated mass detection operation from sequence 4 (S4) to sequence 8 (S8), the barrier discharge period at sequence 5 (S5) is controlled to be a constant period, so that an amount of a measured object to be ionized becomes constant at any operation of the n times of repeated operation, and there is an effect of improving accuracy of the mass spectrometry result.

Figure 3:
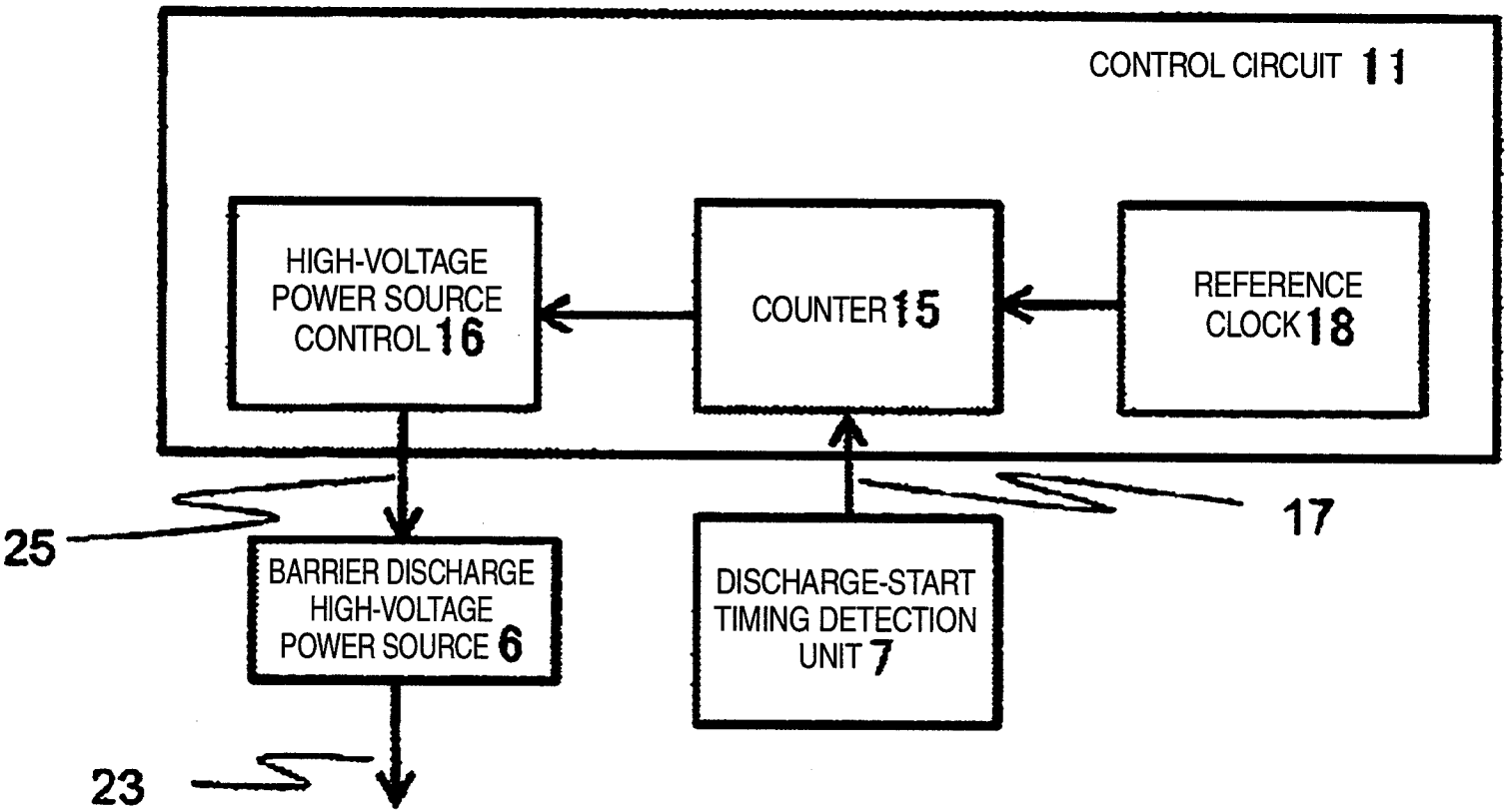
FIG. 3 is an example of a control circuit used in the first embodiment.

FIG. 3 illustrates a configuration example of the control circuit 11 for making the discharge period at sequence 53 (S53) constant. From the discharge-start timing detection unit 7, the discharge-start timing signal 17 is input to a counter 15. In the counter 15, a reference clock 18 is counted for a certain period from the input of the discharge-start timing signal 17, and until the number of counts reaches a certain number, from the high-voltage power source control unit 16, a discharge period pulse 25 is applied as a control signal so that the barrier discharge high-voltage power source 6 outputs a high voltage 23. In the present embodiment, control becomes possible for making the discharge period constant with a simple circuit configuration using the counter.

Figure 4:
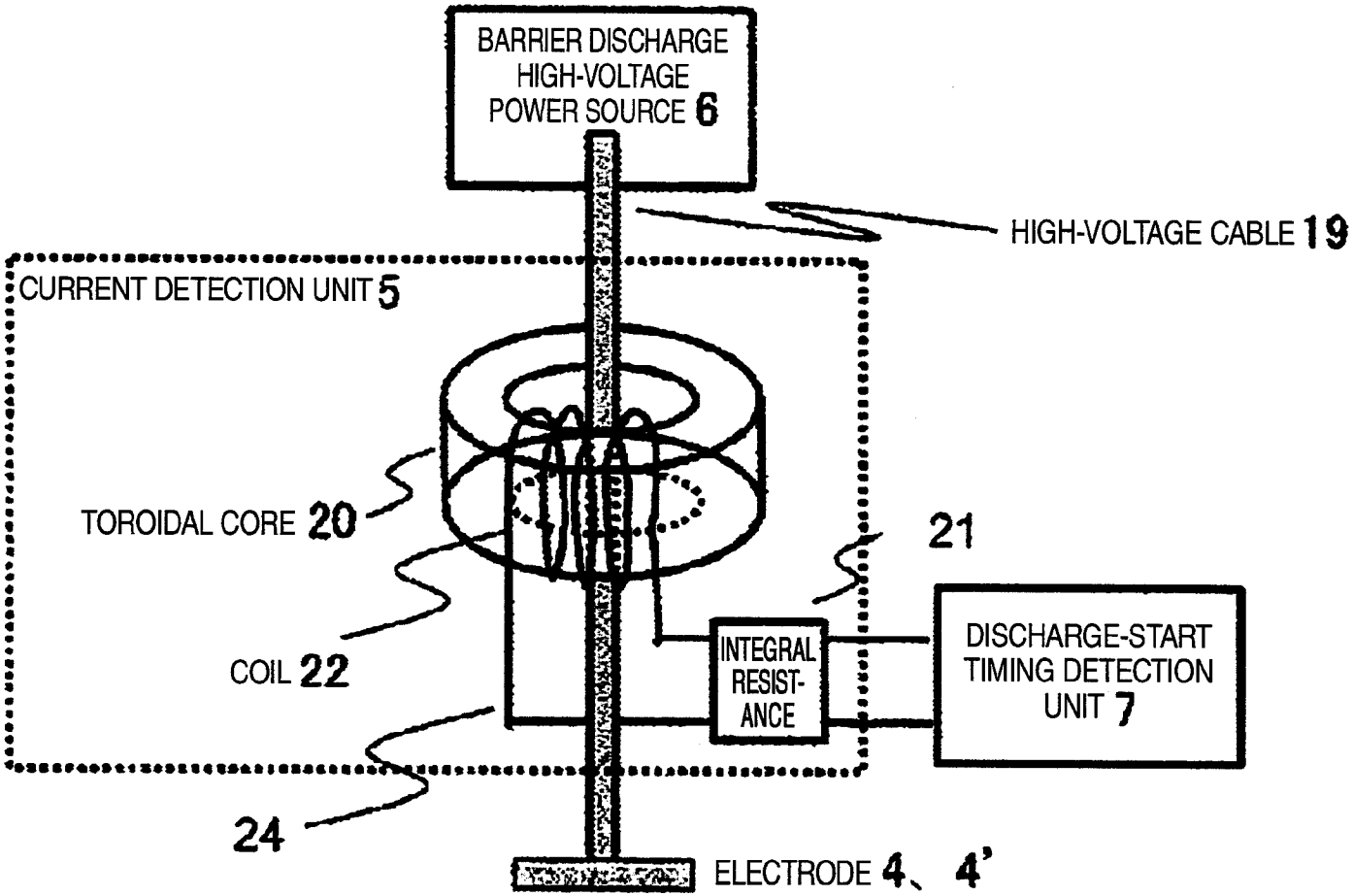
FIG. 4 is an example of a current detection unit used in the first embodiment.

FIG. 4 illustrates an embodiment of the current detection unit 5. The embodiment is configured to apply the voltage to the electrode 4, 4' via a high-voltage cable 19 from the barrier discharge high-voltage power source 6. The high-voltage cable 19 passes through the inside of a toroidal core 20 around which a coil 22 for current induction is wound.

The coil 22 is terminated by an integral resistance 21. A discharge detection current 24, which is induced in the coil 22 by the discharge current 28 flowing through the high-voltage cable 19, is converted to a voltage. The converted voltage is input to the discharge-start timing detection unit 7 to detect the discharge-start timing.

In the present configuration, when the discharge is caused, an induction current is induced in the coil 22 due to the discharge current 28 flowing through the high-voltage cable 19. The induction current is converted to an induction voltage by the integral resistance. When the induction voltage exceeds a predetermined threshold, the discharge-start timing detection unit 7 determines that the discharge is started, and a timing pulse is output to the counter 15 of the control circuit 11. With the present configuration, since the discharge current is detected using the induction current induced in the coil, a noise-resistant, stable discharge current detection is possible.

Figure 5:
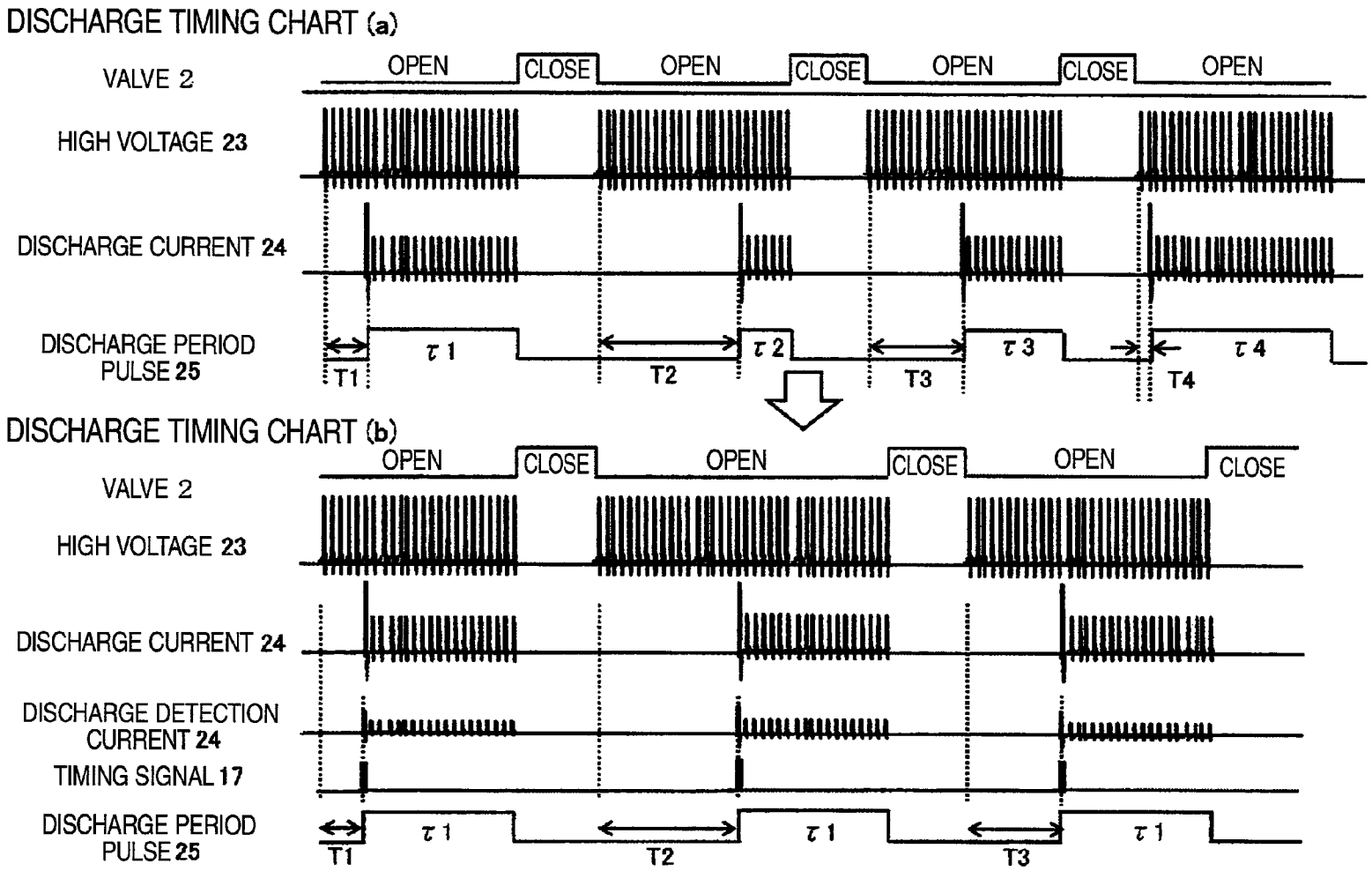
FIG. 5 is an example of a timing chart of the first embodiment.

FIG. 5 illustrates a discharge timing chart example. Discharge timing chart (a) is a timing chart in a conventional configuration that does not detect the discharge-start timing. This is an example of the mass spectrometry flow in FIG. 2, in which sequences of S4-S8 are implemented four times, and the high voltage 23 is applied at the timing when the valve 2 is opened, and after starting application of the high voltage 23, in each of the sequences, the discharge current 28 flows in different timings T1, T2, T3, T4.

Since the period in which the high voltage 23 is applied is the same period in each of the sequences, as a result, the discharge periods become different periods $\tau 1$, $\tau 2$, $\tau 3$, $\tau 4$.

On the other hand, discharge timing chart (b) is a timing chart in a configuration of the present invention that detects the discharge-start timing. This is an example of the mass spectrometry flow in FIG. 2, in which sequences of S4-S8 are implemented three times, and the high voltage 23 is applied at the timing when the valve 2 is opened, and after starting application of the high voltage 23, in each of the sequences, the discharge current 28 begins to flow in different timings T1, T2, T3. From the discharge detection current 24, the discharge-start timing 17 is detected, and the discharge period pulse 25 is controlled to be a constant value $\tau 1$, and along with this, an open time of the valve 2 and an application time of the high voltage 23 are optimized, so that the period of the discharge current 28 also becomes constant. In the example of discharge timing chart (b), since the time in which the discharge current 28 flows is constant in any of the sequences, a stable ionization characteristic of the sample is obtained, and as a result, a stable mass spectrometry result is obtained.

Second Embodiment

In the present embodiment, a configuration and a control method are presented for estimating the discharge-start timing by using pressure detection results in the dielectric container 3 and the detector 9 and for controlling the high voltage output by using the timing.

Figure 6:
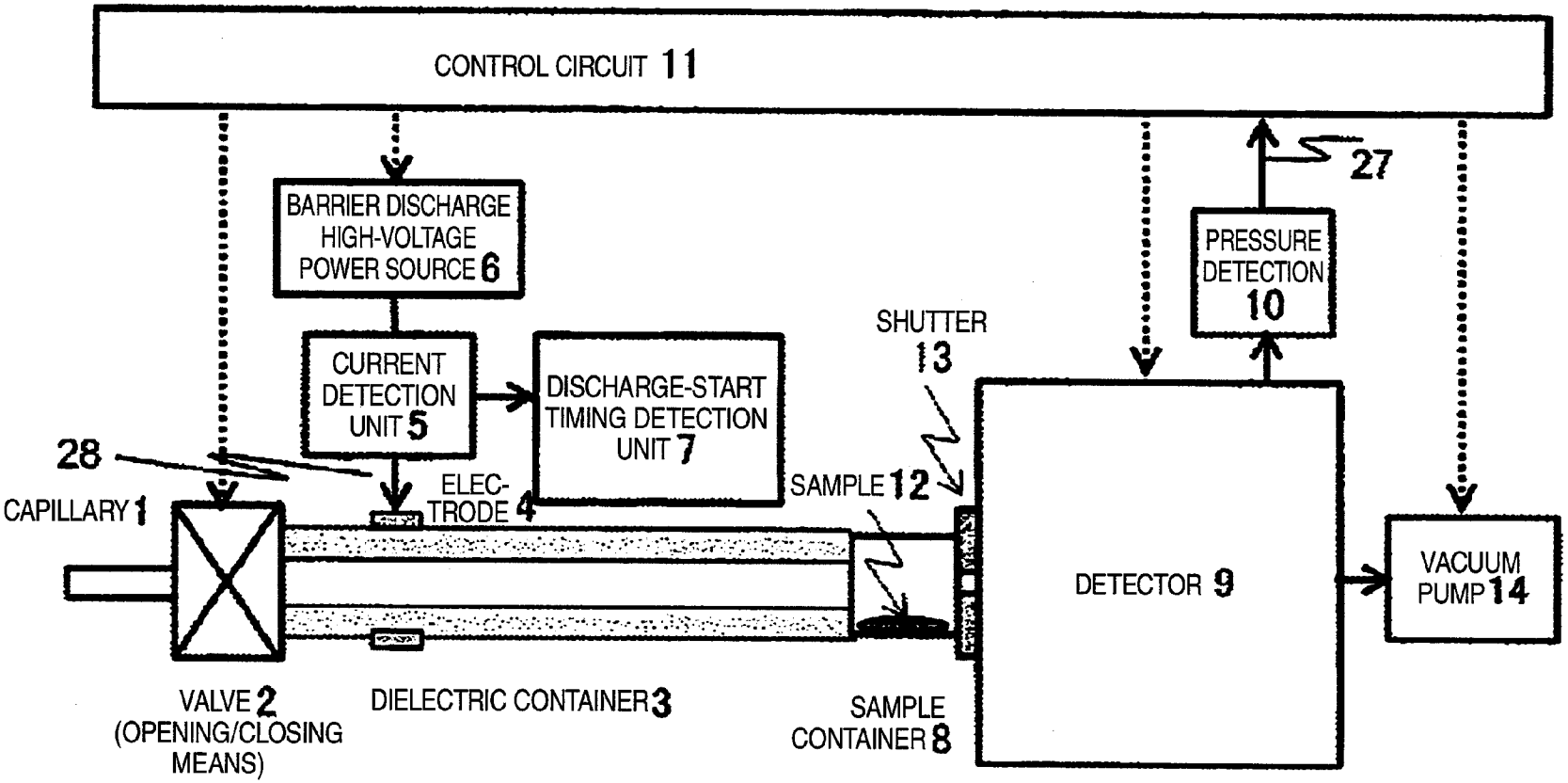
FIG. 6 is an example of a configuration diagram of a mass spectrometric device according to a second embodiment.

FIG. 6 illustrates a block diagram of a mass spectrometric device of the present invention. The mass spectrometric device is configured of: a capillary 1 for introducing an atmosphere; a valve 2 that is an opening/closing means for intermittently sending the atmosphere to a discharge unit; a dielectric container 3 for ionizing (reactant ion generation) the introduced atmosphere by making a discharge current flow through the introduced atmosphere; a barrier discharge high-voltage power source 6 for causing discharge in the dielectric container 3; an electrode 4, electrode 4' each to which a high-voltage power source is applied; a current detection unit 5 for detecting a discharge current 28; a discharge-start timing detection unit 7 for detecting the discharge-start timing from a current detection result; a sample container 8 for containing a measurement sample; a detector 9 for detecting a drug and the like included in the sample by analyzing mass of the sample; a pressure detection unit 10 for detecting pressures in the dielectric container 3 and the detector 9 to provide a pressure detection signal 27 to a control circuit 11 of a control unit; a vacuum pump 14 for reducing the pressures in the dielectric container and the detector; and the control circuit 11 for controlling each block.

Figure 7:
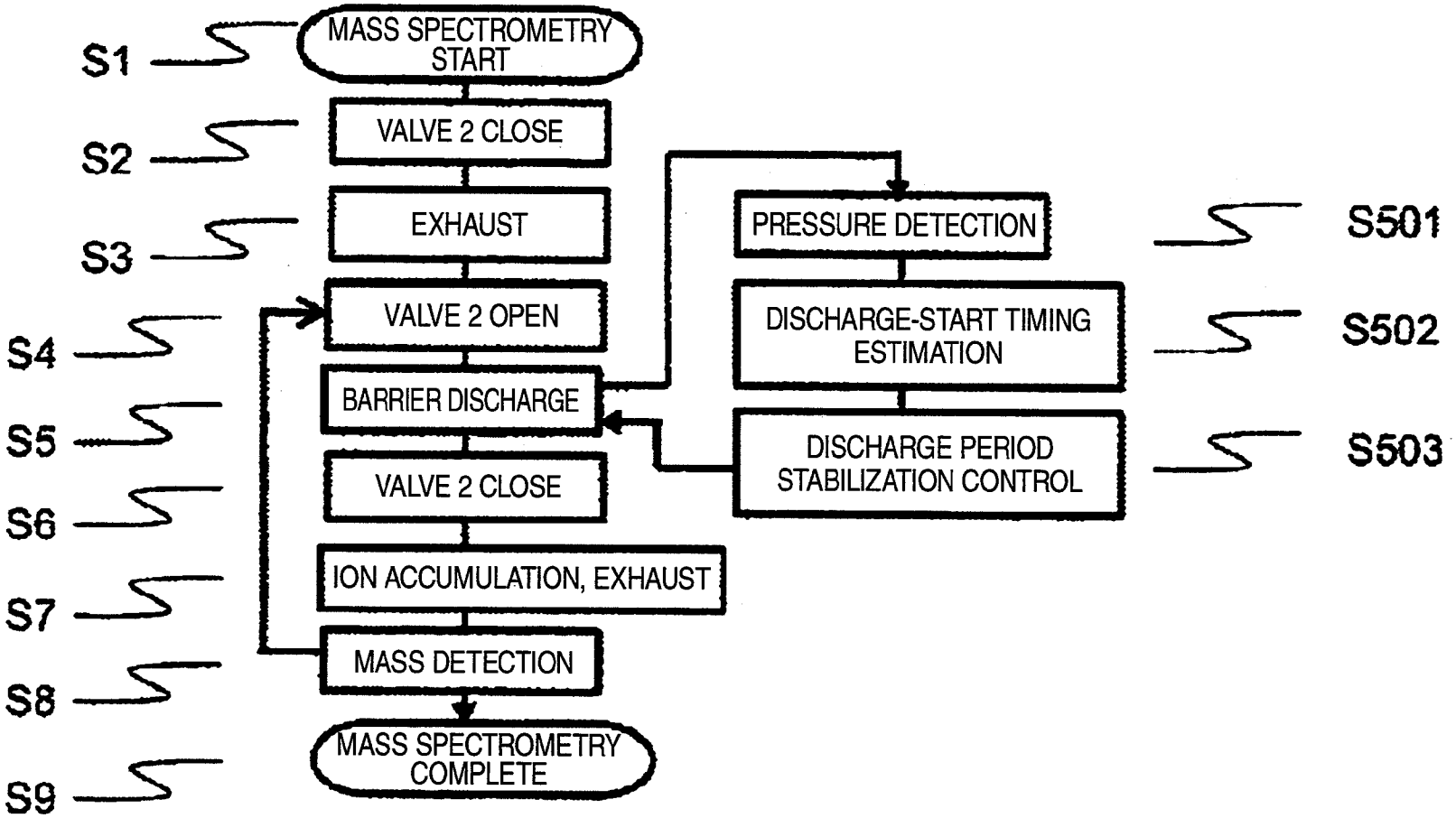
FIG. 7 is an example of an analysis processing flow of the mass spectrometric device according to the second embodiment.

FIG. 7 illustrates a mass spectrometry flow of the mass spectrometric device of the present invention. The mass spectrometry operation is described with reference to the flow. Incidentally, since the general flow from sequence S1 to S9 is the same as the first embodiment, the description is omitted. Here, it is described for the detailed sequence according to the present embodiment.

At sequence 5 (S5), the pulse-like high voltage is applied to the electrode 4, electrode 4' from the barrier discharge high-voltage power source 6. In a period in which the barrier discharge is caused in the dielectric container, at sequence 501 (S501), the pressure detector 10 detects the pressures in the detector 9 and the dielectric container 3. At sequence 502 (S502), from a pressure detection result of the pressure detector 10, the timing is estimated at which the discharge is caused in the period in which the high voltage is applied. As a method for estimating the discharge timing, when a pressure detection value of the pressure detector 10 exceeds a pressure reference value preset in the control circuit 11, it is determined that the discharge is started, and that point of time is made to be the discharge-start timing.

At sequence 503 (S503), based on the estimation result, in the control circuit 11, for a certain time from the estimation discharge-start timing, the discharge period is controlled to be constant by outputting a high voltage from the barrier discharge high-voltage power source 6 to apply to the electrode 4.

As described above, in the repeated mass detection operation from sequence 4 (S4) to sequence 8 (S8), the barrier discharge period at sequence 5 (S5) is controlled to be a constant period, so that an amount of a measured object to be ionized becomes constant at any operation of the n times of repeated operation, and there is an effect of improving accuracy of the mass spectrometry result.

Third Embodiment

In the present embodiment, a configuration and a control method are presented for detecting whether or not the discharge current flows by using discharge current detection and for controlling a high voltage output when the discharge current does not flow.

Figure 8:
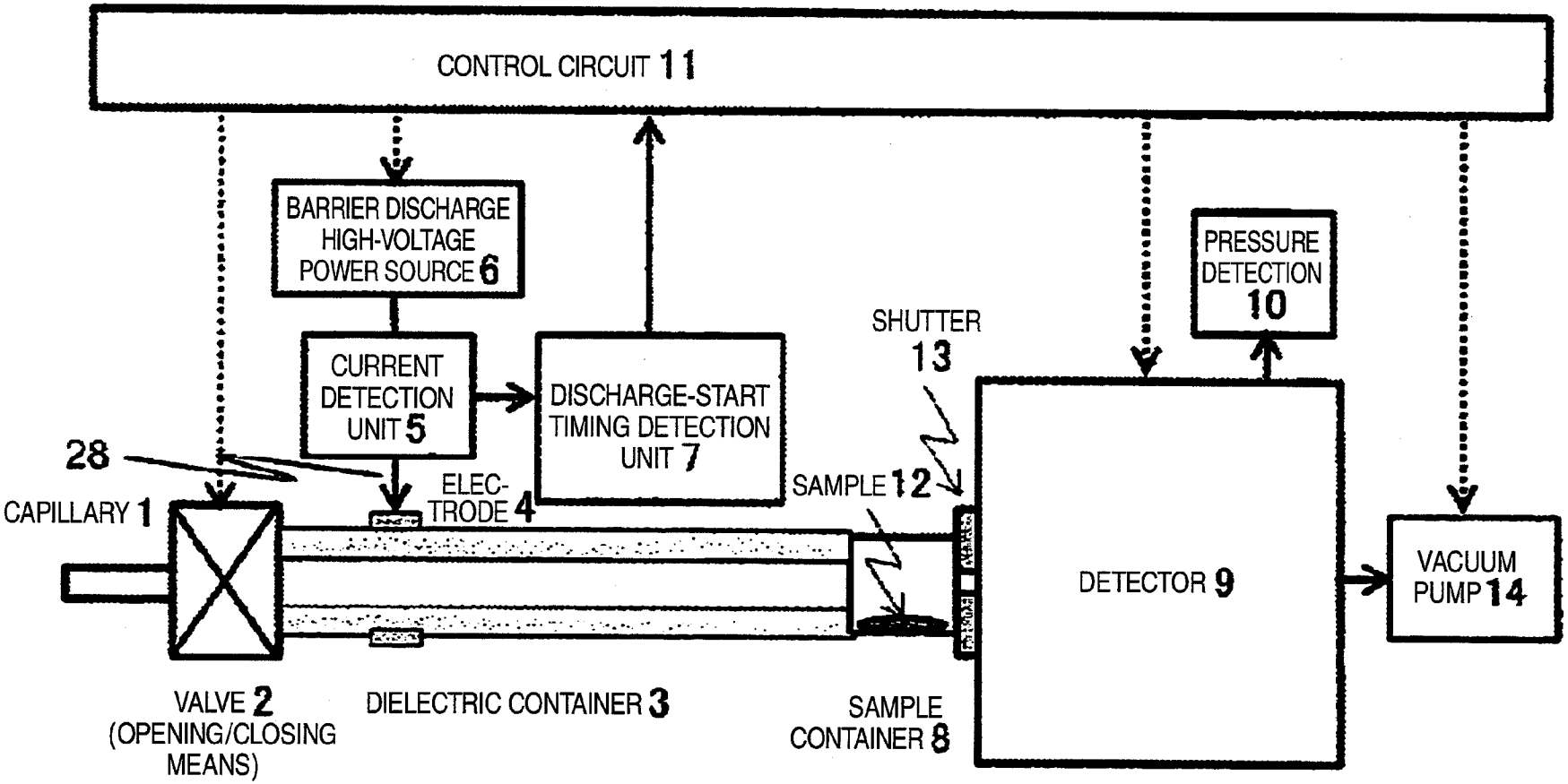
FIG. 8 is an example of a configuration diagram of a mass spectrometric device according to a third embodiment.

First, FIG. 8 illustrates a block diagram of a mass spectrometric device of the present embodiment, which is the same as the block diagram described in FIG. 1 of the first embodiment, so that the description is omitted.

Figure 9:
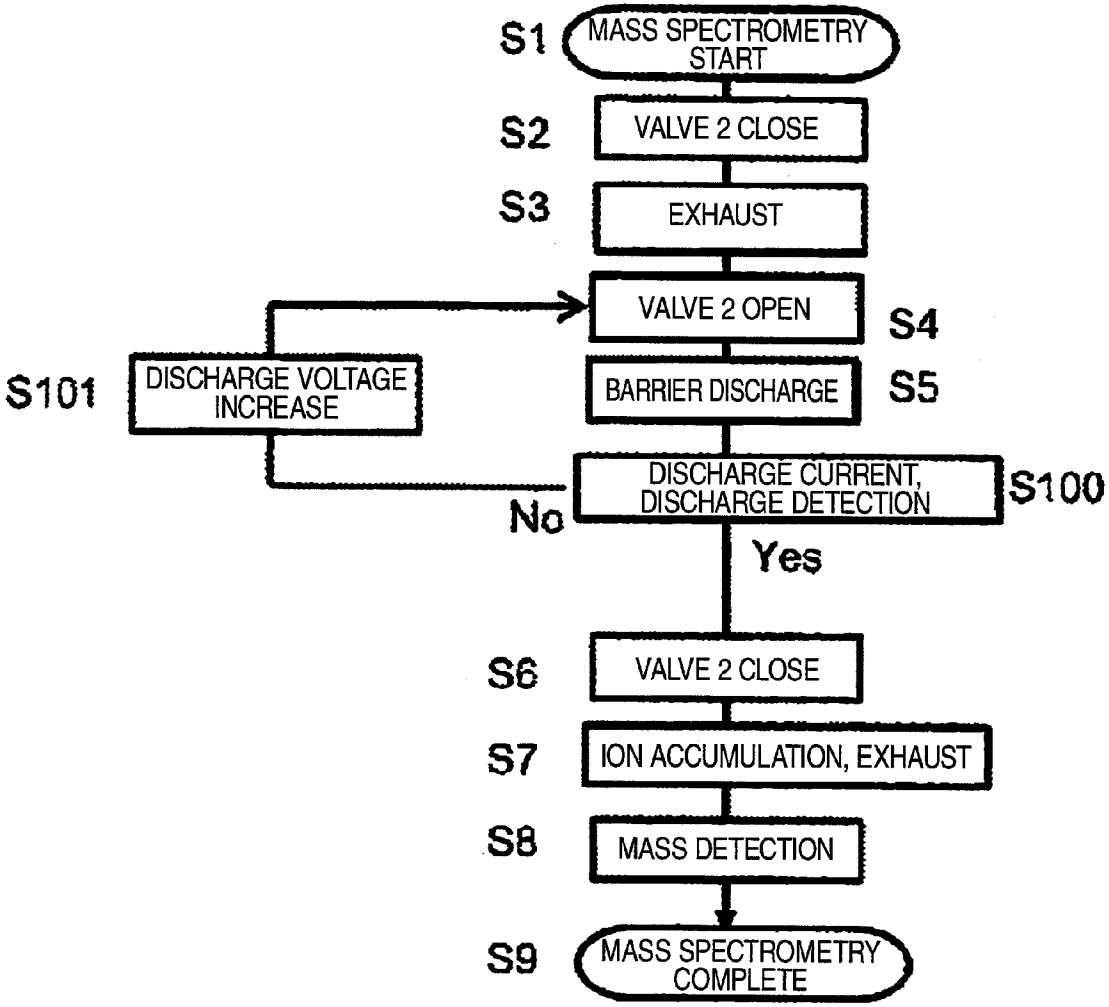
FIG. 9 is an example of an analysis processing flow of the mass spectrometric device according to the third embodiment.

FIG. 9 illustrates a mass spectrometry flow of the mass spectrometric device according to the present embodiment. The mass spectrometry operation is described with reference to the flow. Incidentally, since the general flow from sequence S1 to S9 is the same as the first embodiment, the description is omitted. Here, it is described for the detailed sequence according to the present embodiment.

At sequence 5 (S5), the pulse-like high voltage is applied to an electrode 4, electrode 4' from the barrier discharge high-voltage power source 6. In a period in which the barrier discharge is caused in a dielectric container 3, at sequence 100 (S100), a current detection unit 5 detects a discharge current 28 that flows due to the high voltage applied to the electrode from the barrier discharge high-voltage power source 6. From the detection result, a discharge-start timing detection unit 7 detects the timing at which the discharge is caused in the period in which the high voltage is applied.

At this time, when the discharge-start timing detection unit 7 does not detect the discharge, at sequence 101 (S101), a discharge voltage detection signal 28 is fed back to a control circuit 11 to increase the discharge voltage. When the discharge-start timing detection unit 7 detects the discharge, the discharge voltage detection signal 28 is fed back to the control circuit 11 not to change the discharge voltage.

As described above, in the repeated mass detection operation from sequence 4 (S4) to sequence 8 (S8), it is detected whether or not the discharge current flows, and when the discharge current does not flow, the applied high voltage is controlled to be increased in the next flow, so that an amount of a measured object to be ionized is stabilized in some of the n times of repeated operation, and there is an effect of improving accuracy of the mass spectrometry result.

Figure 10:
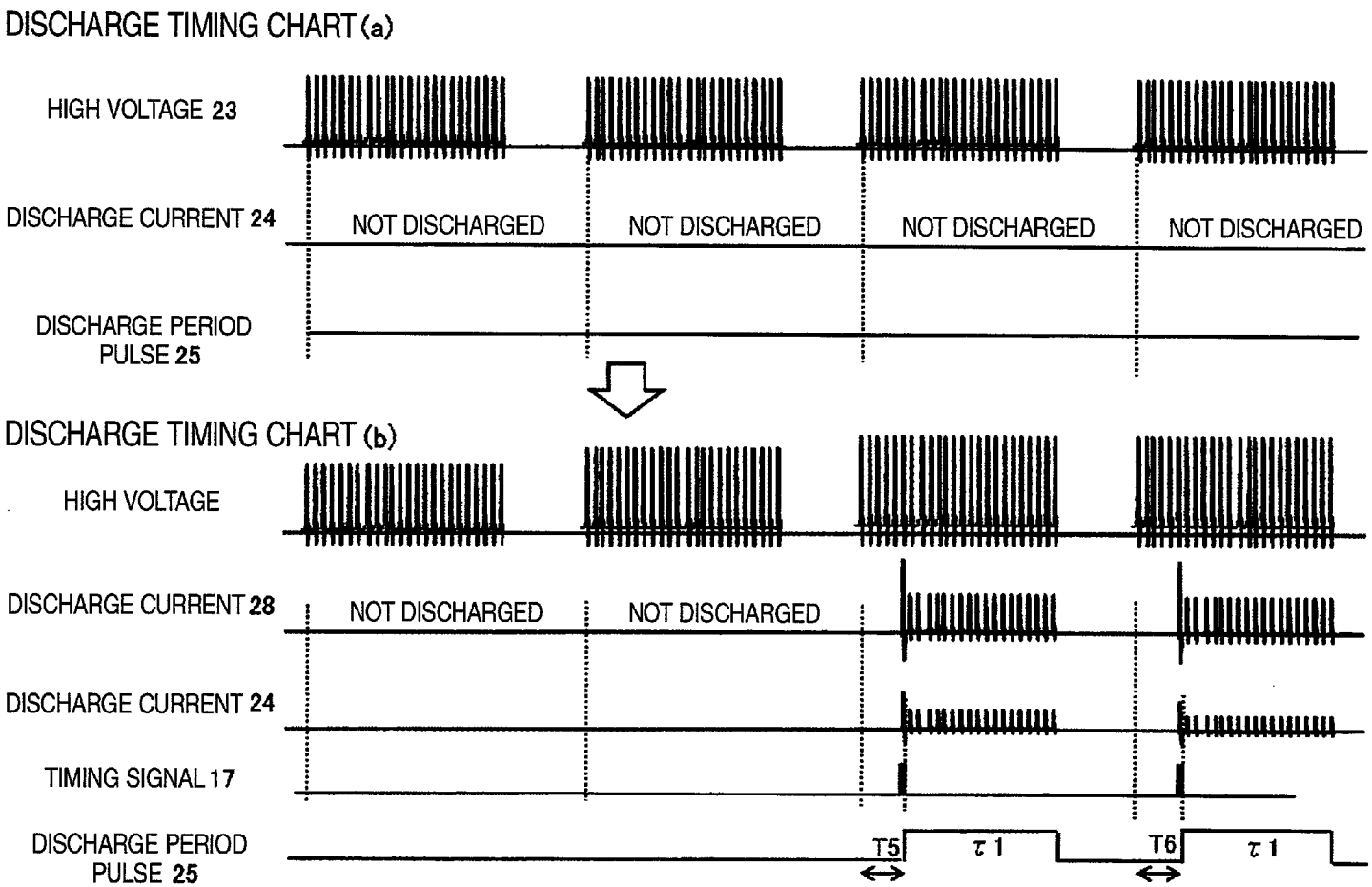
FIG. 10 is an example of a timing chart of the third embodiment.

FIG. 10 illustrates a timing chart example. Discharge timing chart (a) is a timing chart in a conventional configuration that does not detect the discharge-start timing. This is an example of the mass spectrometry flow in FIG. 9, in which sequences of S4-S8 are implemented four times, and the high voltage 23 is applied at the timing when a valve 2 is opened, and after starting application of the high voltage 23, the discharge is not started in each of the sequences.

On the other hand, discharge timing chart (b) is a timing chart in a configuration of the present invention according to the present embodiment that detects the discharge-start timing. In the mass spectrometry flow in FIG. 9, sequences of S4-S8 are implemented four times, and the high voltage 23 is applied at the timing when the valve 2 is opened, and after starting application of the high voltage 23, when the discharge-start timing is not detected, the high voltage 23 is increased in the next flow. On the other hand, when the discharge-start timing is detected, the same high voltage 23 is applied in the next flow. In the example of discharge timing chart (b), since the high voltage is controlled to cause discharge, a stable ionization characteristic of the sample is obtained, and as a result, a stable mass spectrometry result is obtained.

REFERENCE SIGNS LIST

2 valve
5 current detection unit
6 barrier discharge high-voltage power source
7 discharge-start timing detection unit
9 detector
10 pressure detector
11 control circuit
14 vacuum pump
17 discharge-start timing signal
24 discharge detection current
27 pressure detection signal
28 discharge current

The invention claimed is:

1. A mass spectrometric device comprising:

a sample container to hold a measurement sample;

a detector to detect a target included in the sample by analyzing mass of the sample;

a dielectric container connected with the sample container;

a valve for intermittently sending an atmosphere to the sample container, the dielectric container, and the detector;

a barrier discharge high-voltage power source to ionize the atmosphere in the dielectric container by causing a discharge current to flow through the atmosphere in the dielectric container;

a current detection unit connected with the barrier discharge high-voltage power source and to detect a discharge detection current;

a discharge-start timing detection unit connected with the current detection unit and to detect a discharge-start timing based on a current detection result of the current detection unit to transmit a discharge-start timing signal; and a control unit for controlling each of the detector, the valve, the barrier discharge high-voltage power source, the current detection unit and the discharge-start timing detection unit, wherein the current detection unit converts the detected discharge detection current to a voltage, the discharge-start timing detection unit compares the converted voltage with a predetermined threshold and transmits a discharge-start signal to the control unit when the converted voltage exceeds the threshold, and the control unit performs control to cause the discharge current to flow through the atmosphere for a certain period after receiving the discharge-start signal.

2. The mass spectrometric device according to claim 1, wherein the control unit performs control to increase an output voltage of the barrier discharge high-voltage power source when the discharge detection current is not detected by the current detection unit.

3. A mass spectrometric device control method, the mass spectrometric device control method comprising:

detecting a discharge current of a barrier discharge caused by an output voltage of a high-voltage power source;

converting a detected discharge current value to a voltage value;

comparing the converted voltage value with a threshold; and causing the barrier discharge for a certain period after the voltage value exceeds the threshold.

4. The mass spectrometric device control method according to claim 3, further comprising:

increasing the output voltage of the high-voltage power source when the discharge current is not detected.

* * * * *